US005582562A

United States Patent [19]

Wang et al.

[11] Patent Number: 5,582,562

[45] Date of Patent: Dec. 10, 1996

[54] COLLAPSIBLE RIDING TYPE EXERCISE APPARATUS

[75] Inventors: Leao Wang; Peter Wu, both of Taichung Hsien, Taiwan

[73] Assignee: Greenmaster Industrial Corp., Taichung Hsien, Taiwan

[21] Appl. No.: 636,699

[22] Filed: Apr. 23, 1996

[51] Int. Cl.[6] ..... A63B 69/06

[52] U.S. Cl. ..... 482/95; 482/96; 482/72; 482/57

[58] Field of Search ..... 482/95, 96, 72, 482/57, 71, 51, 111; 472/106, 110; 280/1.182, 1.183, 1.192, 1.203, 1.204

[56] References Cited

U.S. PATENT DOCUMENTS 5,299,997 4/1994 Chen ..... 482/96
5,356,357 10/1994 Wang et al. ..... 482/96
5,453,066 9/1995 Richter, Jr. ..... 482/96
5,458,553 10/1995 Wu ..... 482/95
5,464,378 11/1995 Yu ..... 482/95

*Primary Examiner*—Jerome Donnelly
*Attorney, Agent, or Firm*—Bacon & Thomas

[57] ABSTRACT

A collapsible riding type exercise apparatus includes a front frame, a seat bar and a forwardly inclining frame pivotally mounted to a rear frame, a pull bar pivotally disposed on the forwardly inclining frame, and a positioning mechanism located at a pivot joint between the forwardly inclining frame and the rear frame. By means of this arrangement, the exercise apparatus may be quickly closed or opened to facilitate transportation and storage.

3 Claims, 6 Drawing Sheets

COLLAPSIBLE RIDING TYPE EXERCISE APPARATUS

BACKGROUND OF THE INVENTION (a) Field of the Invention

The present invention relates generally to an exercise apparatus, and more particularly to a riding type exercise apparatus which may be collapsed to facilitate transportation, packaging and storage.

(b) Description of the Prior Art

FIG. 1 illustrates a conventional riding type exercise apparatus 10. The exercise apparatus 10 essentially comprises two curved bars 11 arranged in a parallel relationship. Between the two curved bars is disposed a mounting support 12. Two parallel seat bars 13 are respectively, pivotally joined to the two curved bars 11 at their middle sections; the seat bars 13 extend rearwardly from the joints.

A saddle 14 is mounted at the ends of the seat bars 13. A lower action bar 17 and an upper action bar 15 are respectively, pivotally disposed at the front ends of the curved bars 11. The upper action bar 15 has its front end pivotally connected to a handlebar 16, while the lower action bar 17 is fixedly connected to a pair of pedals 18. A linking-up pull stem 19 is pivotally disposed between the seat bars 13 and the lower action bar 17. By means of this arrangement, when the user presses the pedals 18 downwardly while his/her hands grip the handlebar 16 and pull it towards the trunk, the linking-up pull stem 19 is pulled by the lower action bar 17 fixedly connected to the pedals 18 so that the seat bars 13, and hence the user seated on the saddle 14, is lifted upwardly. Although such an exercise apparatus may accomplish the desired exercising effects, it does not take into account of the size of the exercising apparatus. In other words, it is inconvenient to transport, pack or store such exercising apparatus.

SUMMARY OF THE INVENTION

Accordingly, a primary object of the present invention is to provide a collapsible riding type exercising apparatus which is convenient to transport and store, in which a front frame, a seat bar and a forwardly inclining frame are pivotally mounted onto a rear frame; a pull bar is pivotally disposed on the forwardly inclining frame; and a positioning mechanism located at a pivot joint between the forwardly inclining frame and the rear frame.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
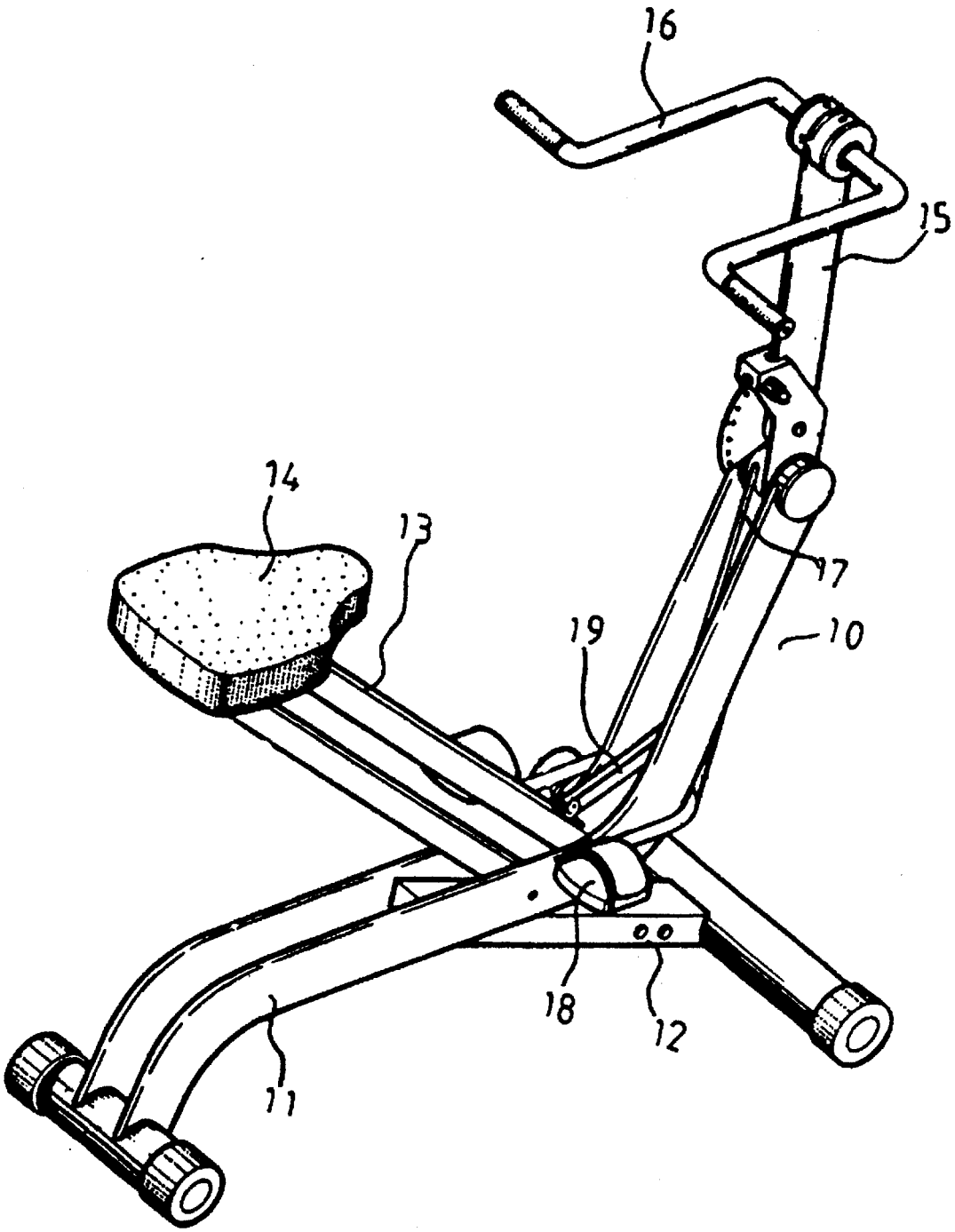
FIG. 1 PRIOR ART
FIG. 1 is an elevational view of a prior riding type exercise apparatus.
Figure 2:
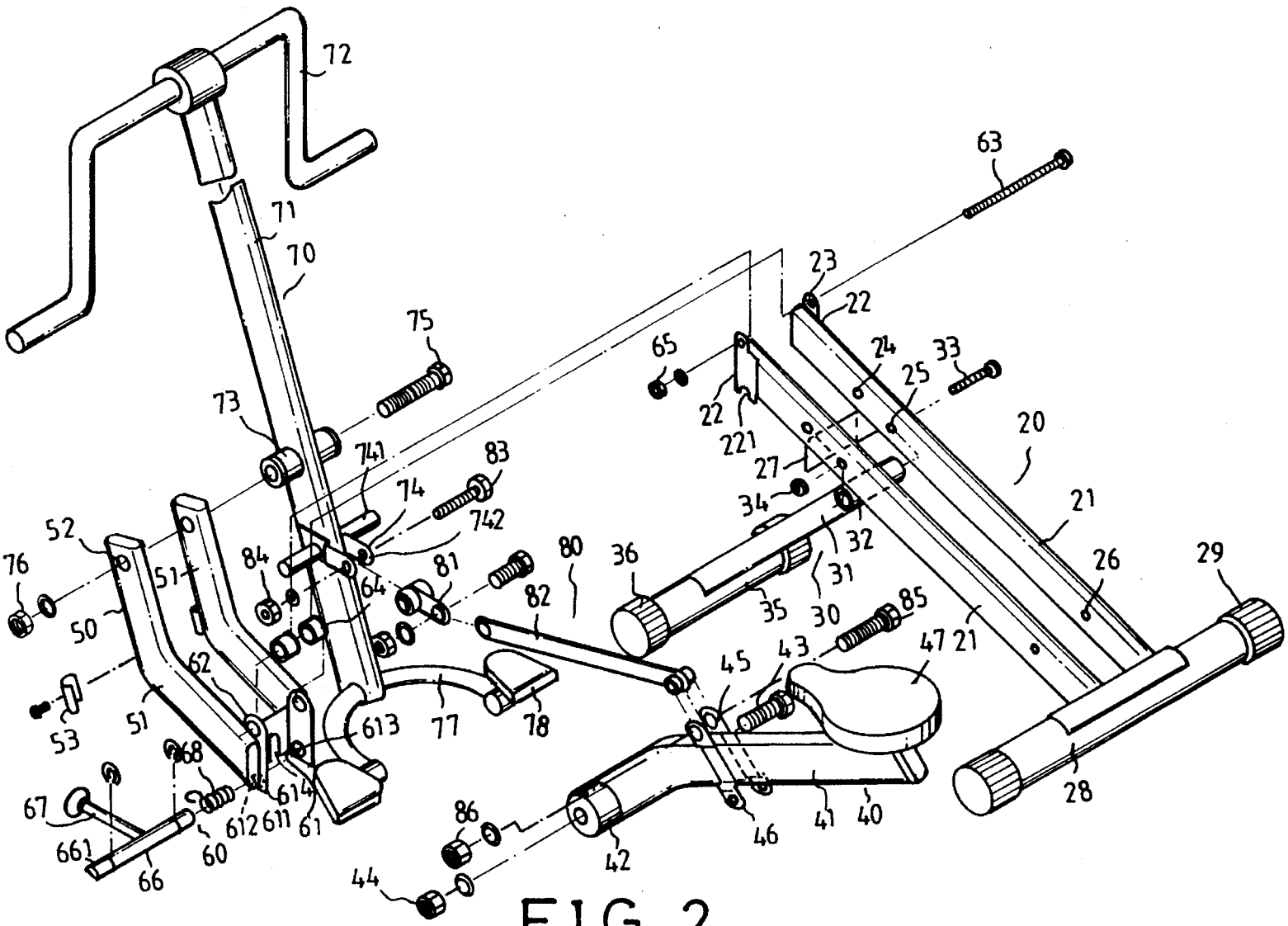
FIG. 2 is an elevational, exploded view of a preferred embodiment of the riding type exercise apparatus of the present invention.
Figure 3:
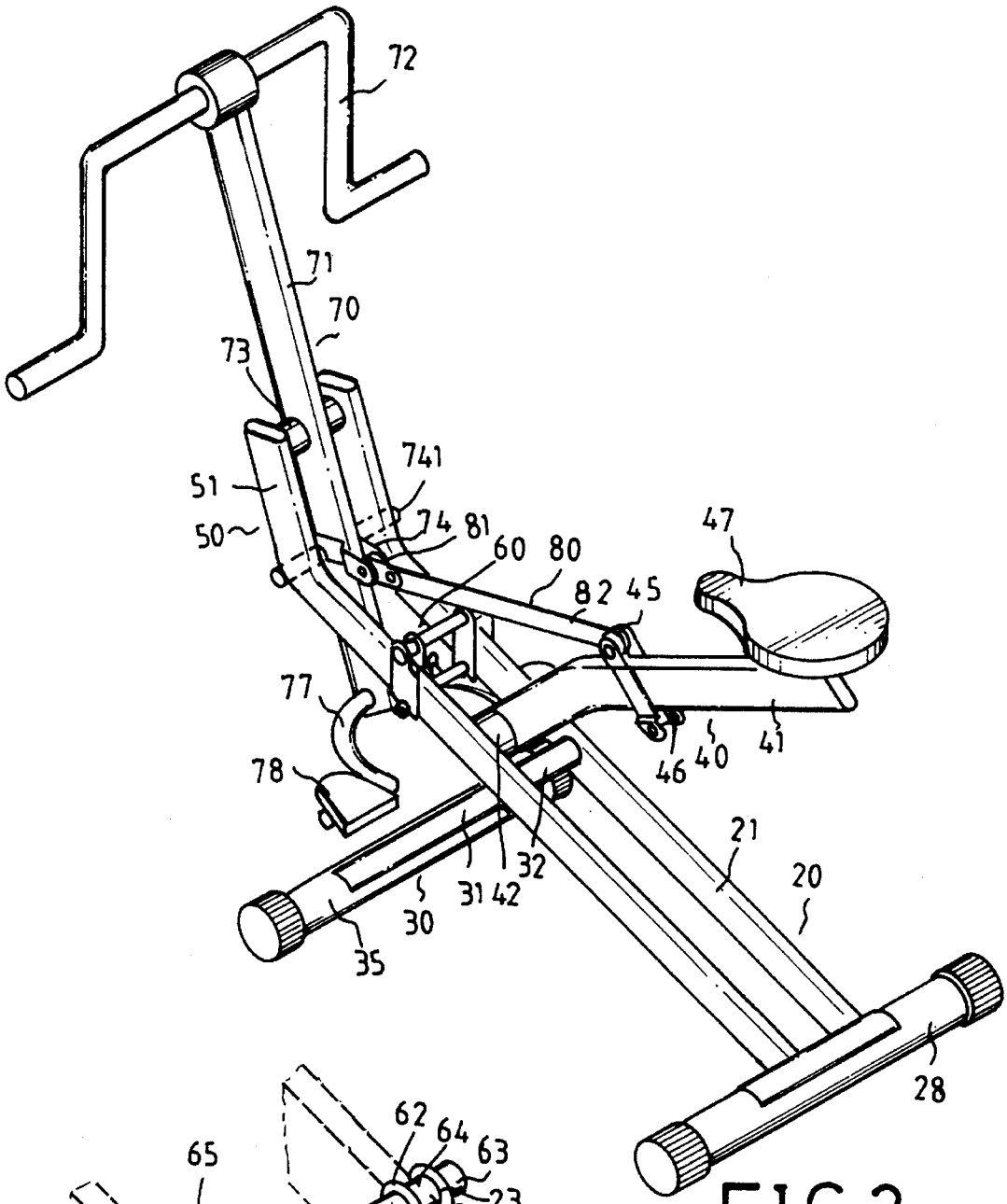
FIG. 3 is an elevational view of the preferred embodiment in an assembled state.

With reference to FIGS. 2 and 3, a preferred embodiment of the collapsible riding type exercise apparatus according to the present invention essentially comprises a rear frame 20, a front frame 30, a seat bar 40, a forwardly inclining frame 50, a positioning mechanism 60, a pull bar 70 and a linking-up pull means 80.

The rear frame 20 consists of two parallel upright bars 21, each of which has a lug 22 welded to a front end thereof. The upright bars 21 are provided with a first pair of pivot holes 22, a second pair of pivot holes 22, a third pair of pivot holes 25 and a pair of reserve holes 26; the first pair of pivot holes 23 is arranged in the pair of lugs 22. Each lug 22 is further provided with a hemispherical notch 221 at a bottom end thereof. An angle block 27 is fixed to the bottom sides of the upright bars 21 at the second pair of pivot holes 24. Both extreme rear ends of the upright bars 21 are fixedly connected to a rear horizontal tube 28 for supporting the exercise apparatus on the floor, the horizontal tube 28 having its ends fitted with plastic caps 29.

The front frame 30 consists of a flat support bar 31 having a front end pivotally connected to a pivot tube 32. The pivot tube 32 is pivotally joined to the rear frame 20 at the third pair of pivot holes 25 by means of a pin 33 and a nut 34. The support bar 31 further has its rear end fixedly connected to a front horizontal tube 35 for supporting the exercise apparatus on the floor, the front horizontal tube 35 having both ends fitted with plastic caps 36.

The seat bar 40 consists of a slightly curved bar body 41 and a shaft 42 horizontally disposed at a front end thereof. The shaft 42 is pivotally connected to the rear frame 20 at the second pair of pivot holes 24 by means of a pin 43 and a nut 44. A pair of upper pivot lugs 45 and a pair of lower pivot lugs 46 are respectively near a middle section of the bar body 41. A saddle 47 is further disposed at a rear end of the bar body 41.

The forwardly inclining frame 50 consists of two curved bars 51 arranged in a parallel relationship. The front ends of the two curved bars 51 are provided with a fourth pair of pivot holes 52. A plastic baffle block 53 is arranged at a back side of each curved bar 51 at a predetermined position. In addition, the positioning mechanism 60 is welded to near the rear ends of the curved bars 51. The positioning mechanism 60 consists of an inverted-U shaped frame 61. The frame 61 has two side plates 611 each of which is provided with a through hole 612. Corresponding lugs 62 are provided at one end of the side plates 611. The lugs 62 allow the passage of a pin 63, a sleeve 64 and a nut 65 therethrough for connecting the forwardly inclining frame 50 to the rear frame 20 at the first pair of pivot holes 23 disposed at the lugs 22. A horizontal bar 66 is passed through the through holes 612 of the side plates 611. A pull stem 67 has one end joined to a middle section of the horizontal bar 66 such that the pull stem is substantially perpendicular to the horizontal bar 66. The horizontal bar 66 is further fitted with a spring 68 which has one end hooking the pull stem 67 and the other end hooking a narrow gap 613 in one of the side plates 611. By means of the resilience of the spring 68, the pull stem 67 may be accommodated in a slot 614 in the frame 61. The two ends of the horizontal bar 66 which project from the side plates 611 are cut to form hemispherical positioning sections 661.

The pull bar 70 consists of a bar body 71 and a handlebar 72 pivotally provided at a front end of the bar body 71. A tube 73 is inserted through a mounting hole near a middle section of the bar body 71, and a U-shaped seat 74 is mounted a distance below the tube 73. By means of using a pin 73 and a nut 76, the tube 73 of the pull bar 70 is pivotally locked to the fourth pair of pivot holes 52 at the forwardly inclining frame 50. Both sides of the U-shaped seat 74 extend to form two horizontal posts 741 and a pair of lugs 742. Two curved rods 77 extend from both sides of the bar body 71 respectively at the extreme rear end thereof. A pedal 78 is mounted on each curved rod 77.

The linking-up pull means 80 consists of a front pull stem 81 and a rear pull stem 82 pivotally connected together, the front pull stem 81 and the rear pull stem are different in length. The front pull stem 81 is pivotally connected to the lugs 742 of the U-shaped seat 74 of the pull bar 70 by means of a pivot 83 and a nut 84, while the rear pull stem 82 is pivotally locked at the lugs 45 of the seat bar 40 by means of a pin 85 and a nut 86.

The components as well as their relative positions of the riding type exercise apparatus according to the present invention has been described as above. After assembly, the rear horizontal tube 28 of the rear frame 20 and the front horizontal tube 35 of the front frame 30 are supported on the floor, and the front portion of the front frame 30 is stopped by the angle block 27 of the rear frame 20. The forwardly inclining frame 50 is mounted to the rear frame 20 by means of the positioning mechanism 60 fixedly provided at its rear end. In other words, a hemispherical surface 662 of each positioning section 661 adheres to the hemispherical notch 221 of each lug 22 of the rear frame 20. The pull bar 67 is located at the slot 614 of the frame 61 to cause the two curved bars 51 of the forwardly inclining frame 50 and the two upright bars 21 of the rear frame 20 to join integrally.

Figure 5:
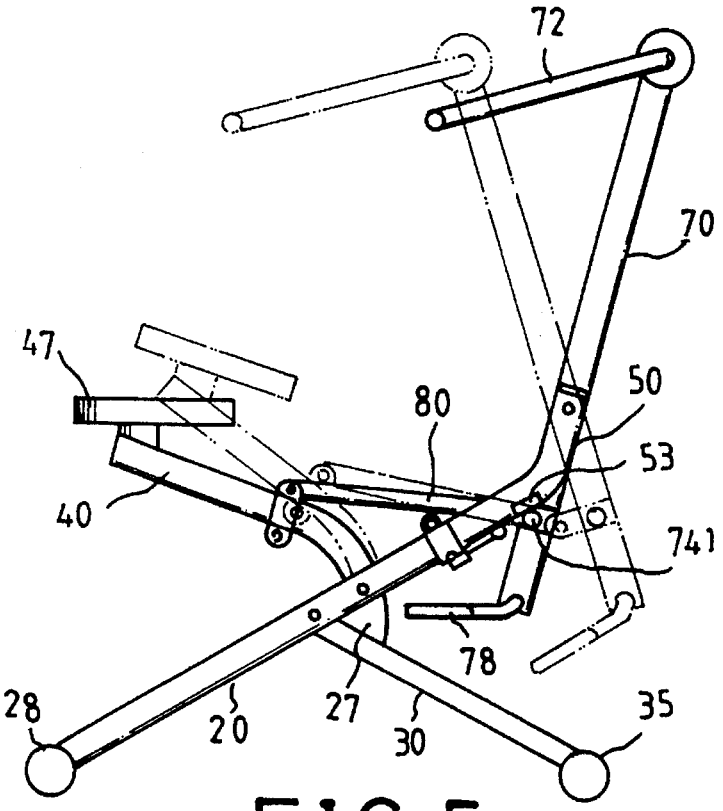
FIG. 5 is a schematic view illustrating action of the exercise apparatus of the invention.

With reference to FIG. 5, when the user is seated on the saddle 47 with both feet on the pedals 78 at the bottom end of the pull frame 70 and exerts a forwardly downward force with both feet, while his/her hands grip and pull the handlebar 72 at the front end of the pull frame 70 towards the trunk, the linking-up pull means 80 will bring the seat bar 40 and the saddle 47, hence the user seated thereon, to lift forwardly, achieving the object of exercising. When force is released, the posts 741 of the pull frame 70 will be stopped by the baffle blocks 53 of the forwardly inclining frame 50, controlling and preventing excessive forward displacement.

Figure 6:
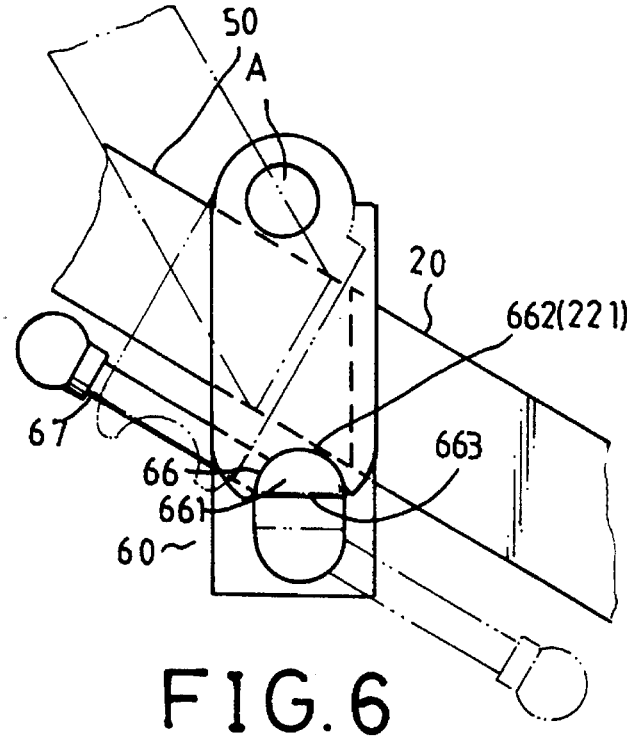
FIG. 6 is a first side view illustrating the closing of the exercise apparatus of the invention.
Figure 7:
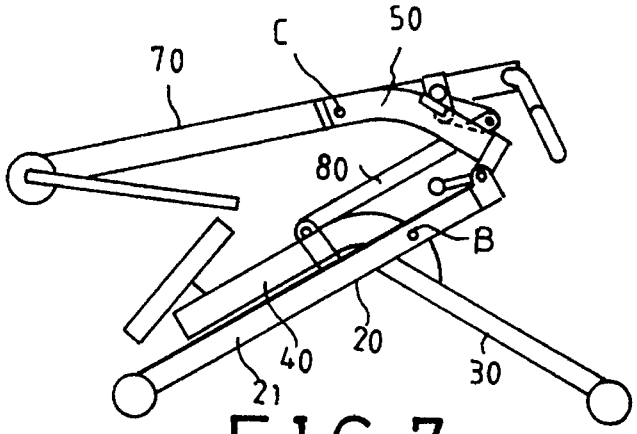
FIG. 7 is a second side view illustrating the closing of the exercise apparatus of the invention.
Figure 8:
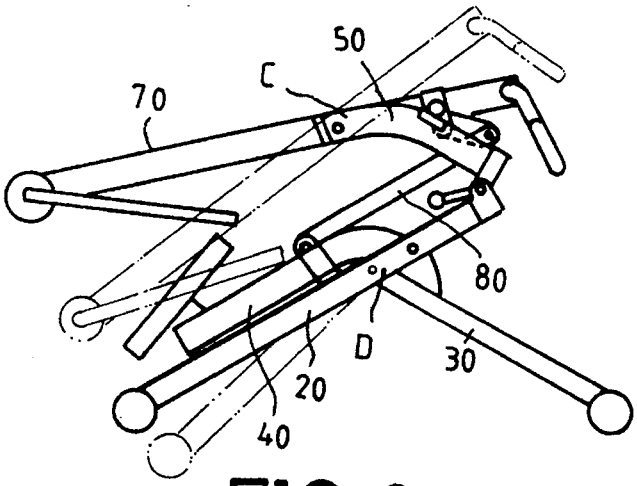
FIG. 8 is a third side view illustrating the closing of the exercise apparatus of the invention.
Figure 9:
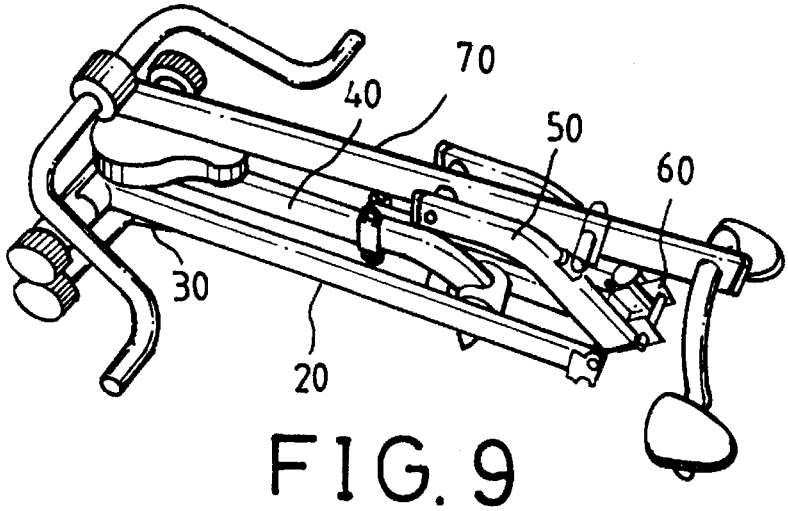
FIG. 9 is a schematic view illustrating the exercise apparatus in a collapsed state.

For collapsing the exercise apparatus of the invention, reference is made to FIGS. 6, 7 and 8. The pull stem 67 of the positioning mechanism 60 is firstly pulled rearwardly, bringing the horizontal bar 66 to turn so that the curved surfaces 662 of the hemispherical positioning sections 661 disengage from the hemispherical notches 221 of the rear frame 20, allowing a planar surface 663 to locate opposite to the hemispherical notch 221. Then the forwardly inclining frame 50 is pushed forwardly. The forwardly inclining frame 50 in turn swings rearwardly with a joint A between itself and the rear frame 20 as a pivot, so that the positioning sections 661 displace therewith to move away from the restriction of the hemispherical notches 221. Subjected to the resilience of the spring 68, the pull stem 67 resets to the slot 614 of the frame 61. At the time when the forwardly inclining frame 50 displaces rearwardly, the seat bar 40 is subjected to the rearward displacement of the linking-up pull means 80 so that it displaces downwardly and forwardly with a joint B between itself and the rear frame 20 as a pivot towards the two upright bars 21 of the rear frame 20. Then, with a joint C between the pull bar 70 and the forwardly inclining frame 50 as the pivot, the pull bar is pulled towards the collapsed forwardly inclining frame 50 and the seat bar 40. Finally, using a joint D between the front frame 30 and the rear frame 20 as a pivot, the front frame 30 is moved towards the rear frame 20. Thus the entire exercise apparatus of the invention may be collapsed into a compact unit as shown in FIG. 9. It does not occupy much floor space and may be delivered, loaded or stored without any difficulty.

Figure 4:
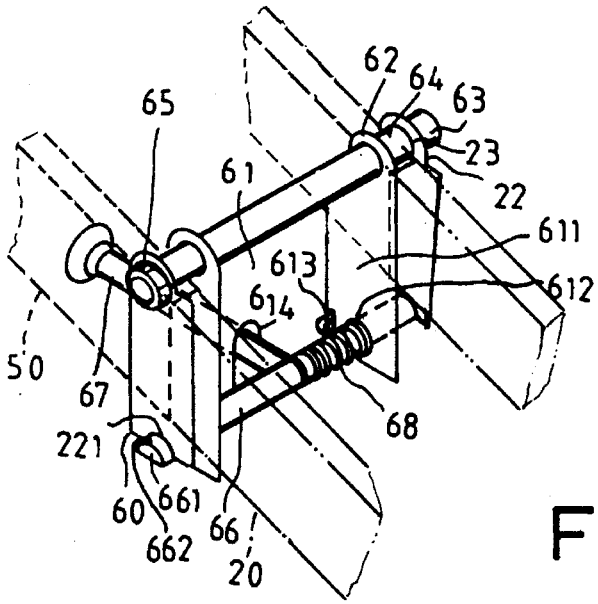
FIG. 4 is a schematic view illustrating a positioning mechanism mounted at the exercise apparatus of the invention.
Figure 10:
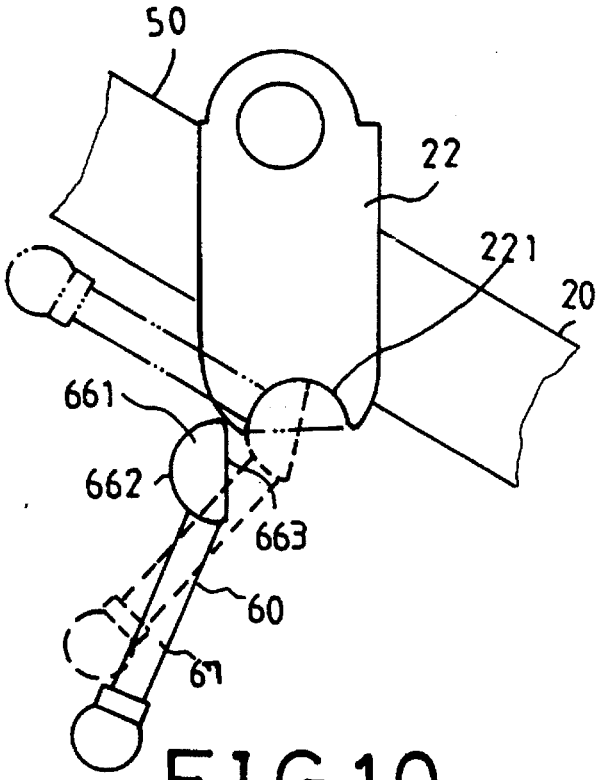
FIG. 10 is a schematic view illustrating the action of the positioning mechanism when the exercise apparatus is being collapsed.

In order to open the exercise apparatus of the invention after its is collapsed, the above procedures are repeated in a reverse order to open the frame 30, the pull bar 70, the seat bar 40 and the forwardly inclining frame 50. When the front end of the front frame 30 is baffled by the angle block 27 at the bottom side of the rear frame 20, press the forwardly inclining frame 50 downwardly with force so that the positioning sections 661 of the positioning mechanism 60 utilizes the planar surfaces 663 to turn about the outer periphery of the hemispherical notches 221 of the rear frame 20, as shown in FIG. 10. The pull stem 67 will be brought to displace rearwardly so that the positioning sections 661 slide into the corresponding hemispherical notches 221, and when the subjected to the resilience of the spring 68 which is stretched, the pull stem 67 is caused to turn forwardly through an angle so that the curved surfaces 662 half lie against the hemispherical notches 221. Then the pull stem 67 is moved forwardly so that is resets to the slot 614 of the frame 61, while the positioning sections 661 have their curved surfaces 662 completed within the hemispherical notches 221, as shown in FIG. 4, accomplishing the opening of the exercise apparatus of the invention.

Figure 11:
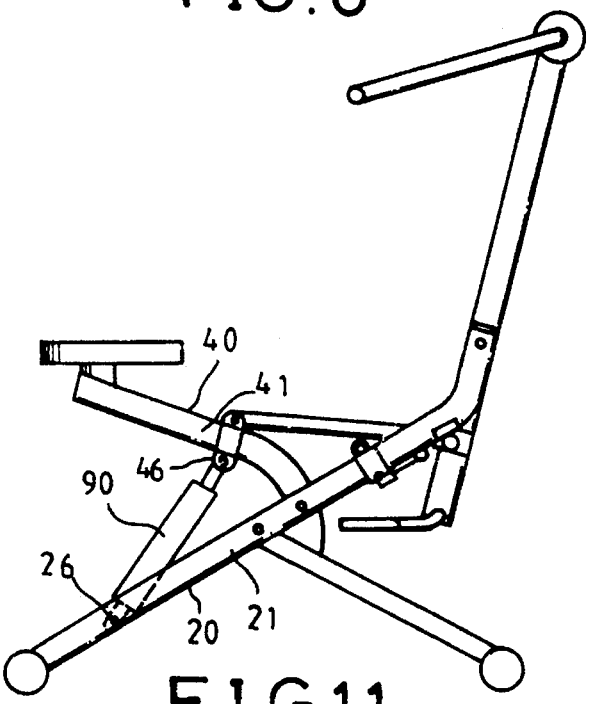
FIG. 11 is a schematic view of another preferred embodiment of the exercise apparatus of the invention, showing a hydraulic cylinder mounted thereon.

Furthermore, with reference to FIG. 11, a hydraulic cylinder 90 may be installed between the lower pivot lugs 46 of the bar body 41 of the seat bar 40 and the reserve holes 26 of the two upright bars 21 of the rear frame 20.

In summary, by means of mounting the front frame, the seat bar and the forwardly inclining frame pivotally to the rear frame and by means of arranging the pull bar pivotally on the forwardly inclining frame and the positioning mechanism at the pivot joint of the forwardly inclining frame and the rear frame, the exercise apparatus of the invention may be quickly closed or erected, alleviating the problems of transporting and loading the exercise apparatus as in the prior art.

Although the present invention has been illustrated and described with reference to the preferred embodiment thereof, it should be understood that it is in no way limited to the details of such embodiment but is capable of numerous modifications within the scope of the appended claims.

What is claimed is:

1. A collapsible riding type exercise apparatus, comprising:

a rear frame consisting of two parallel, upright bars having two corresponding lugs welded thereto at the front ends thereof, a first pair of pivot holes being arranged in said lugs, a second pair of pivot holes, a third pair of pivot holes and a reserve pair of pivot holes being formed at said upright bars at predetermined positions, said lugs being each provided with a hemispherical notch at a bottom end thereof, an angle block being fixedly mounted at the bottom side of said rear frame at said second pair of pivot holes, a rear horizontal bar being fixedly provided at the rear ends of said upright bars for supporting said rear frame on the floor;

a front frame consisting of a support bar having a pivot tube located at a front end thereof, said pivot tube being pivotally mounted at said rear frame at said third pair of pivot holes, and a front horizontal tube fixedly provided at a rear end of said support bar;

a seat bar consisting of a slightly curved bar body having a shaft horizontally disposed at a front end thereof, said shaft being pivotally mounted on said rear frame at said second pair of pivot holes, a pair of upper lugs and a pair of lower lugs being fixedly provided at a middle section of said bar body, and a saddle being mounted at a rear end of said bar body;

a forwardly inclining frame consisting of two parallel, curved bars which are provided with a fourth pair of pivot holes near their front ends, a positioning mechanism welded between said curved bars near their rear ends, said positioning mechanism consisting of an inverted-U shaped frame having two side plates each of which has a through hole, said side plates each having a pair of corresponding lugs at one end thereof, said lugs being pivotally joined to said lugs of said rear frame at said first pair of pivot holes, a horizontal bar being inserted through said through holes of said side plates, a pull stem extending vertically from a middle section of said horizontal bar and a spring being fitted onto said horizontal bar, said spring having one end hooking said pull stem and the other end hooking a narrow gap in one of said side plates, said pull stem being allowed to locate in a slot formed in said frame by means of the resilience of said spring, said horizontal bar having its ends projecting from said side plates to form hemispherical positioning sections, which are located in said hemispherical notches of said lugs of said rear frame after assembly;

a pull bar consisting of a bar body, a handle bar pivotally disposed at a front end thereof, a tube disposed near a middle section of said body, an U-shaped seat mounted a suitable distance below said tube, said tube being pivotally joined to said forwardly inclining frame at said fourth pair of pivot holes, said U-shaped seat having a pair of corresponding lugs extending therefrom, and two curved rods extending from both sides of said bar body respectively, each of said curved rods having disposed thereon a foot pedal;

a linking-up pull means consisting of a front pull stem and a rear pull stem of different lengths pivotally connected together, said front pull stem being pivotally joined to said lugs of said U-shaped seat, and said rear pull stem being pivotally joined to said lugs of said seat bars.

2. The collapsible riding type exercise apparatus as claimed in claim 1, wherein said two posts are horizontally disposed at both sides of said U-shaped seat of said pull bar, and a plastic baffle block is mounted at a rear side of each of said curved bars of said forwardly inclining frame at a predetermined position.

3. The collapsible riding type exercise apparatus as claimed in claim 1, wherein a hydraulic cylinder is disposed between said pair of lower lugs of said bar body of said seat bar and said pair of reserve holes of said upright bars of said rear frame.

* * * * *